United States Patent [19]

Vo Thanh et al.

[11] Patent Number: 4,776,570

[45] Date of Patent: Oct. 11, 1988

[54] LADLE STREAM BREAKER

[75] Inventors: Khuong Vo Thanh, Montréal; Michel Rigaud, Ville Mont-Royal, both of Canada

[73] Assignee: Sidbec Dosco Inc., Montreal, Canada

[21] Appl. No.: 71,165

[22] Filed: Jul. 8, 1987

[51] Int. Cl.[4] ..... C21B 3/04

[52] U.S. Cl. ..... 266/44; 266/229

[58] Field of Search ..... 266/44, 230, 227, 238, 266/280, 286, 287; 164/437, 337, 335

[56] References Cited

U.S. PATENT DOCUMENTS

| | | | |
|---|---|---|---|
| 3,814,167 | 6/1974 | Listhuber et al. | 164/437 |
| 4,125,146 | 11/1978 | Muller et al. | 266/238 |
| 4,312,668 | 1/1982 | Mannion et al. | 266/287 |

FOREIGN PATENT DOCUMENTS

| | | | |
|---|---|---|---|
| 1101325 | 7/1984 | U.S.S.R. | 164/437 |

*Primary Examiner*—L. Dewayne Rutledge
*Assistant Examiner*—S. Kastler
*Attorney, Agent, or Firm*—Foley & Lardner, Schwartz, Jeffery, Schwaab, Mack, Blumenthal & Evans

[57] ABSTRACT

A ladle stream breaker is disclosed, for use in a tundish comprising a pouring zone where a stream of molten metal is poured from a casting ladle through a pouring tube, and a flotation zone downward the pouring zone, where the molten metal free from its inclusions flows out through a vertical outlet tube into a continuous casting mold. The stream breaker consists of a closed box made from a refractory material, which box has a top wall provided with an opening sized to receive the lower end of the pouring tube, and a number of lateral walls each provided with a plurality of openings sized to allow the molten metal injected into the box to escape from this box in the form of a plurality of sub-streams of low energy. The lateral walls of the closed box and their openings are arranged in such a manner that every sub-stream flowing out of its associated opening impinges a wall of the tundish and flows in a direction substantially perpendicular to this tundish wall. This ladle stream breaker is particularly interesting in that it efficiently dissipates the kinetic energy of the stream of molten metal poured into the tundish and reduces the depth of penetration of this stream inside the tundish, thereby preventing any slag being formed in the pouring zone from being entrained downstream.

4 Claims, 2 Drawing Sheets

LADLE STREAM BREAKER

BACKGROUND OF THE INVENTION (a) Field of the Invention

The present invention relates to a ladle stream breaker for use in a tundish to continuously cast metal slabs, especially steel slabs.

(b) Brief Description of the Prior Art

It is of common practice in any continuous casting process to use a piece of equipment called "tundish", for separating slag and other contaminants from the molten metal being cst. Such a tundish is an intermediate vessel which is positioned between a casting ladle containing the molten metal to be cast, and a casting mold which is usually vertical. The molten metal is poured from the ladle into the tundish at one end thereof. The molten metal then flows along the vessel toward the other end thereof. The length of the vessel is selected to provide a time of residence of the metal in the tundish sufficient to allow separation of the inclusions as a floating slab layer. At the other end of the tundish, the molten metal free from its inclusions flows through a vertical outlet tube into the mold from which the solidifying cast slab is continuously drawn out.

Numerous studies have been made up to now to optimize the configuration and design of the existing tundishes, in order to achieve better inclusion separation, less slab entrainment into the mold, less skulling and higher metallic yield.

The solutions that have been proposed up to now and are presently used in most of the existing tundishes to improve flotation of the inclusions, are:

(1) an increase in the size of the tundish and more particularly its length; and/or (2) the addition of generally one partition dam or weir into this tundish (see, for example, U.S. Pat. Nos. 3,814,167 and 4,125,146), both in order to increase the residence time of the molten metal in the tundish.

The partition, dam or weir usually extend vertically across the tundish and stop short from its bottom wall. It divides the tundish into a first portion hereinafter called "pouring box", extending from the partition towards the one end wall of the tundish, and a second portion hereinafter called "flotation box" extending from the partition towards the other end wall of the tundish. Of course, all of the walls of the tundish and its partition that are or may be in contact with the metal to be cast, are lined with, or made from a refractory material.

In use, the metal to be cast is fed in molten state as a stream from the ladle into the pouring box, where it is subjected to great turbulences. This allows sometimes tundish to be used as an "open chemical reactor" in which it is possible to introduce additives or alloys beneath a thick metal layer in a very well mixed volume, where dissolution rate is maximized.

Then, the molten metal flows from the pouring box into the flotation box under the partition, thereby preventing any slab being formed in the pouring box from being entrained.

Thereafter, the molten metal flows along the entire length of the flotation box toward the outlet tube in a very uniform manner without any short circuit, thereby allowing optimum plug flow volume to achieve high inclusion separation before the molten metal flows out of the tundish into the casting mold.

In most industrial applications, the stream of molten metal, fed from the ladle into the pouring box of the tundish, has to be shrouded to prevent reoxydation of the molten metal being cast. Such a shrouding is usually achieved by pouring the ladle stream into the tundish through a tube of refractory material which acts as an injection nozzle.

If the use of such a pouring tube has the requested advantage of shrouding the stream, it also has the major drawbacks of:

(1) preventing the kinetic energy of the stream of molten metal being poured from the ladle at a given height over the tundish from being sufficiently dissipated; and (2) generating eddy currents inside the pouring box.

Both of these drawbacks in turn cause some of the slag being formed in the pouring box to be entrained out of the same into the flotation box.

To tentatively solve this problem, it has already been suggested to inject an inert gas into the pouring tube to reduce the compactness of the stream and thus its depth of penetration. This solution is rather efficient in practice if the level of metal in the tundish is high and the metal flow is not too high. If, however, the level of metal is low and/or the metal flow is high, the bubbles of gas that are injected and move up around the pouring tube inside the pouring box, "push" the slag layer on top of the pouring box away from the tube wall around the same, and thus create an annular zone where the molten metal is exposed to air and subject to reoxydation.

OBJECT OF THE INVENTION

The object of the present invention is to provide a ladle stream breaker for use in a tundish as disclosed hereinabove, which breaker can be mounted at the lower end of a pouring tube to efficiently dissipate the kinetic energy of the stream of molten metal poured from a casting ladle into the tundish and thus reduce the depth of penetration of this stream inside the tundish. This energy dissipation advantageously prevents any slag being formed in the stream injection zone from being entrained downstream into the tundish and thus allows better inclusion separation.

SUMMARY OF THE INVENTION

In accordance with the invention, the above mentioned object is achieved with a ladle stream breaker for use in a tundish comprising a pouring zone of given shape where a stream of molten metal is poured from a ladle through a pouring tube, and a flotation zone downstream the pouring zone, which stream breaker merely consists of a closed box made from refractory material. The box has a top wall provided with an opening to receive the lower end of the pouring tube, and a number of lateral walls each provided with a plurality of openings sized to allow the molten metal injected into the box through the nozzle to escape from this box in the form of a plurality of substream of low energy. The lateral walls of the box and their openings are arranged in such a manner that every substream flowing out of its associated opening impinges a wall of the tundish and flows in a direction substantially perpendicular to this impinged wall.

In order to provide maximum dissipation of the energy of the molten metal flowing out of the box through the lateral openings the lateral walls are preferably made from or converted with a thick layer of refractory material.

In addition, the opening in the lateral wall of the closed box are preferably made square in shape.

When the ladle stream breaker according to the invention is intended to be used in a tundish having a pouring zone which is substantially square in shape and has a flat bottom wall, the closed box is preferably cubic and sized to lay flat on the bottom wall of the pouring zone just under the pouring tube. This particular arrangement is of a particular interest since it prevents the closed box forming the stream breaker from having to be attached to the lower end of the pouring tube.

In accordance with the invention, dissipation of the kinetic energy of the stream of molten metal flowing through the pouring tube is due to the presence of a given amount of molten metal trapped into the closed box mounted at the lower end of the pouring tube, which "cuts off" the injection stream impact. Energy dissipation is also due to the friction undergone by the molten metal escaping through the openings provided in the lateral walls of the closed box. Accordingly, to increase the energy dissipation, one may either reduce the size of the openings or increse the thickness of the walls to increase friction.

In this regard, tests carried out by the inventors have shown that the best results are obtained with square openings about 1.5 cm wide for use in a tundish of conventional size.

In accordance with the invention, it is compulsory that every sub-stream escaping through a lateral opening of the closed box impinges a wall of the tundish and flows in a direction substantially perpendicular to this wall. Indeed, such an orientation of the sub-streams with respect to the walls of the pouring box of the tundish reduces to a substantial extent the generation of turbulences and eddy currents and thus prevents the slag formed into the pouring box from being entrained downstream into the flotation box, especially when the level of metal in the tundish is or becomes low. Such a substantial reduction in the amount of slag entrained into the flotation box downstream the pouring box is particularly interesting, because the presence of slag in the flotation box reduces the efficiency of the synthetic slag and the other additives that may be added to the molten metal to cause emergency and flotation of the metal inclusions.

In addition, it is worth mentioning that, by using a suitable refractory material, the closed box forming the ladle breaker can also be used as a filter to trap and retain large inclusions contained in the ladle stream.

BRIEF DESCRIPTION OF THE DRAWINGS

The invention and its numerous advantages will be better understood on reading the following non restrictive description of a preferred embodiment thereof, made with reference to the accompanying drawings in which.

DESCRIPTION OF THE TUNDISHES SHOWN IN FIGS. 1 AND 2

Figure 1:
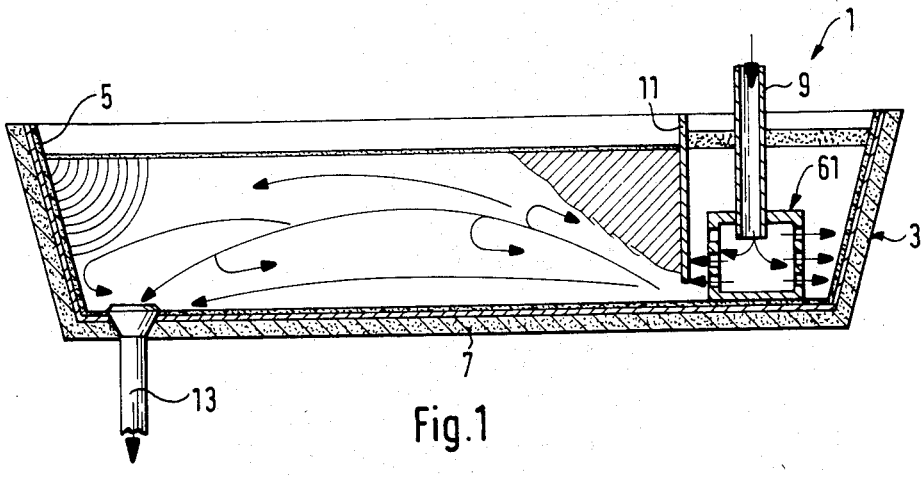
FIG. 1 is a schematic representation of a conventional tundish provided with a flat bottom and a transversal partition, which tundish is shown in longitudinal cross-section and provided with a ladle stream breaker according to the invention.

The tundish 1 shown in FIG. 1 is a conventional structure and comprises an elongated vessel or basin 3 whose internal walls in contact with the molten metal, are lined with a refractory material 5. The basin 3 which usually has an upwardly open, trapezoidal cross-section and a flat bottom 7 may be, for example, 412 cm long, 115 cm width and 90 cm height in order to handle the amount of molten metal usually poured from a standard 150 tons ladle.

The molten metal is poured from a casting ladle (not shown) at one end of the basin through a pouring tube 9, upstream a transversal partition 11 extending transversally across the basin from the top of the tundish down to a short distance from its bottom wall 7. The main purposes of this partition 11 are to increase the residence time of the molten metal inside the tundish and improve the mixed flow volume in the same.

At the other end of the vessel 3, the molten metal flows out from the tundish through a nozzle 13 into a water cooled mold (not shown) which may, for example, be 17.5 cm thick. To prevent vortexing above the tundish nozzle 13 and slag entrainment into the mold, it is compulsory to keep the metal level in the tundish at a height of at least 20 cm above the nozzle 13. Usually, the molten metal height inside the tundish is maintained at about 82 cm during casting. When casting is completed, it is however required to keep into the tundish an amount of molten metal of at least 20 cm high, thereby substantially reducing the metallic yield.

In use, argon may be injected into the molten metal stream shrouded in the pouring tube 9. Nominal casting speeds may vary from 10 cm/mn. to 150 cm/mn. depending on the width of the slabs to be cast and the molten metal temperature. In practice, slabs of 6.1 m long with width varying from 0.814 to 1.524 m are currently casted.

Figure 2:
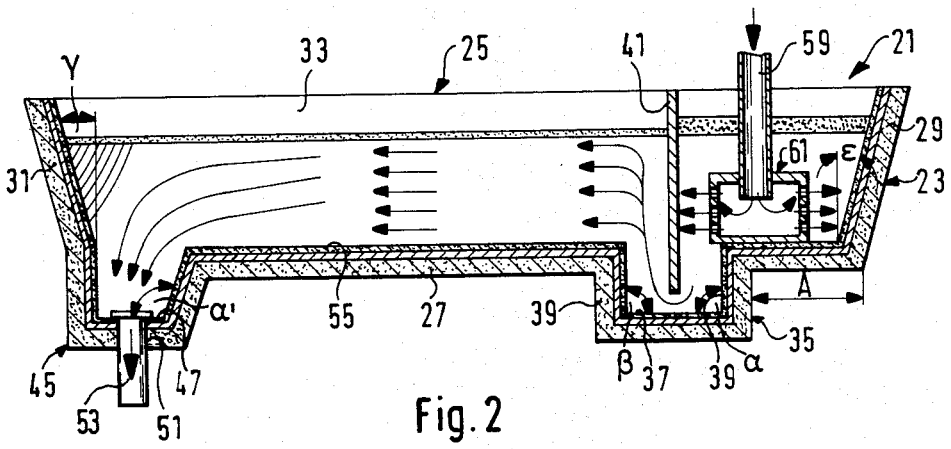
FIG. 2 is a schematic representation of a tundish of improved structure, which tundish is also shown in longitudinal cross-section and provided with a ladle stream breker according to the invention.

The tundish 21 shown in FIG. 2 has an improved structure which forms the subject matter of copending patent application No. 062,575 filed on June 16, 1987 in the name of the same Applicant. This tundish 21 comprises an elongated vessel or basin 23 having an open top 25, a flat bottom wall 27, a pair of opposite end walls 29 and 31 and a pair of opposite side walls 33. In transversal cross-section, the tundish 21 may be in the shape of an inverted trapezium of any other cross-sectional shape used in the industry.

A first recess 35 hereinafter also called "flow orientation and slag retainer box", is provided in the bottom wall 27 of the basin at a given distance A from the end wall 29. This first recess 35 extends downwardly and transversally across the basin between the side walls 33, and has a bottom wall 37 and a pair of opposite walls 39 perpendicular to the side wall 33 of the basin.

A vertical partition 41 extends transversally across the basin between the side walls 33 just over the first recess 35. The partition 41 extends vertically from the top of the basin down into the first recess 31 at about mid distance between the opposite walls 39 of this recess. The partition 41 which stops short from the bottom wall of the first recess, forms therewith the kind of baffle to which the molten metal must flow, and divides the basin into a first portion hereinafter called "pouring box" extending from the partition 41 towards the one end wall 29 of the basin, and a second portion hereinafter called "flotation box" extending from the partition 41 towards the other end 31 of the basin.

A second recess 45 hereinafter also called "antivortex box", is provided in the bottom wall 27 of the basin adjacent the other end wall 31 of this basin. This second recess 45 extends downwardly and transversally across the basin between the side walls 33 and has a bottom wall 47 provided with a central opening 51. An outlet nozzle 53 extends downwardly from the central opening of the second recess through the bottom wall thereof.

As clearly shown in FIG. 2, the opposite end walls 29 and 31 of the basin are upwardly and outwardly inclined at angle respectively designated as $\epsilon$ and $\gamma$. As also shown in FIG. 2, the opposite walls 39 for the first recess 35 are parallel and perpendicular to the bottom walls 27 and 37 of the basin and first recess respectively. However, it is worth mentioning that these opposite walls 39 could also be upwardly and outwardly inclined at respective angles of $\alpha$ and $\beta$ if desired. As further shown in FIG. 2, the bottom wall 47 of the second recess 45 is joined to the bottom wall 27 of the basin by a wall 49 upwardly inclined at an angle $\alpha'$, in a direction opposite to the other end wall 31 of the basin adjacent the second recess, so as to smoothly direct the molten metal toward the central opening 51 and thus reduce as much as possible turbulences.

Of course, all of the walls of the basin 23, the first and second recesses 35 and 45, the partition 41 and the outlet nozzle 53 that are or may be in contact with the molten metal to be cast, are lined with or made from a refractory material 55.

In use, the metal to be cast is fed in molten state as a stream from the ladle (not shown) into the pouring box through a pouring tube 59, upstream the partition 41.

After pouring, the molten metal flows under the partition 41, from the pouring box into the flotation box through the flow orientation and slag retainer box 35, thereby preventing any slag being formed in the pouring box from being entrained. In addition of preventing such an entrainment of the slag, the flow orientation box 35 causes formation of an upward stream rising from the bottom of the first recess 35 along the partition 41. This is of the uppermost importance since this allows optimal inclusion separation and substantial reduction of dead volume zones in the basin downstream the partition 41.

Then, the molten metal flows along the entire length of the flotation box in a very uniform manner without any "short circuit", thereby allowing optimum plug flow volume. In the flotation box, the height of metal is minimal, which is very favourable for inclusion separation. In addition, as shown with arrows in FIG. 2, the flow is mostly of the plug flow type and the slag layer is less perturbated, thus easing the emergence of inclusions.

At the opposite end of the tundish 21, the molten metal reaches the second recess 45 and files it up to form in this second recess and antivortex volume above the outlet nozzle. Advantageously, the height of the antivortex box is selected to keep a head of 20 cm of metal above the nozzle orifice as it is of usual practise to avoid slag entrainment. Thanks to this antivortex box, the flotation box can be emptied almost completely, thereby allowing substantial reduction in the amount of metal "lost" in the tundish after every casting sequence.

As can now be understood, the tundish shown in FIG. 2 comprises four consecutive boxes each of which has its wn utility.

The pouring box upstream the partition 41 is used to receive the ladle stream and dissipates its energy.

The flow orientation box defined by the first recess 35 provides an extra step which forces the metal stream down and up. This box acts as a good barrier which prevents from carrying over reoxidation and desoxidation products. In addition, the upward movement of the metal just behind the partition 41 eliminates almost most of the stagnant volume in the tundish.

The flotation box downstream the partition 41 has a height which can be minimal, thereby making the box very favourable for inclusion separation. The flow is mostly of the plug flow type and the slag layer is less perturbated, thus easying the emergence of inclusions.

Last of all, the antivortex box defined by the second recess 45 provides the extra depth required to avoid turbulence even in the flotation box is emptied completely. In addition, the streams around the nozzle are directly sucked in and do not bound on the rear wall.

The four boxes listed hereinabove are used altogether to achieve optimization of the tundish characteristics. Greater details on the advantages that result from this optimization can be found out in the specification of copending patent application No. 062,575 referred to hereinabove.

DETAILED DESCRIPTION OF THE INVENTION

Figure 3:
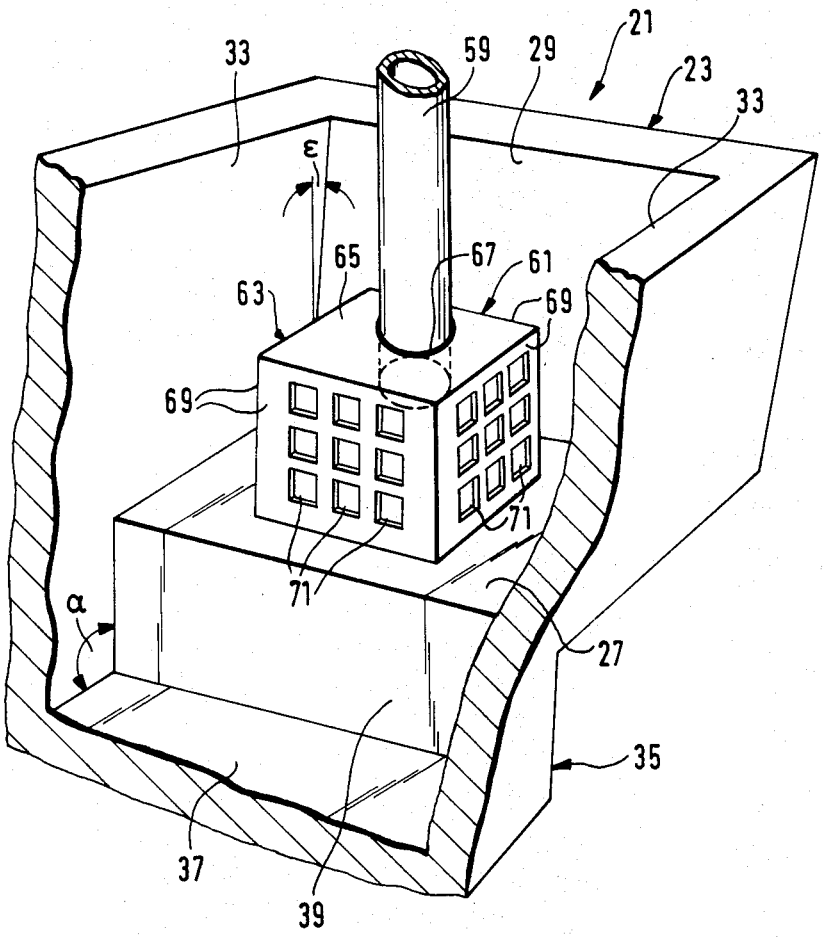
FIG. 3 is a perspective view of the pouring box of the tundish shown in FIG. 2, showing in greater details the structure and positioning of the ladle stream breaker according to the invention.

The ladle stream breaker 61 according to the invention can be used either with the tundish 1 of conventional structure shown in FIG. 1, or with the improved tundish 21 shown in FIG. 2. As better shown in FIG. 3, the stream breaker 61 consists of a closed box 63 made exclusively of a refractory material or, alternatively, of a piece of metal lined with a thick layer protective refractory material.

The box 63 has a top wall 65 provided with an opening 67 sized to receive the lower end of the injection nozzle 9 or 69. The box 63 also has a number of lateral walls 69 each provided with a plurality of openings 71 sized to allow the molten metal injected into the box through the nozzle to escape therefrom in the form of a plurality of sub-streams of low energy.

In accordance with the invention, the lateral walls 69 of the box and the openings 71 are arranged and orientated in such a manner that every sub-stream shown with arrow in FIGS. 1 and 2, which sub-stream flows out of every opening 71, impinges a wall of the tundish and flows in a direction substantially perpendicular to this impinged wall.

When the tundish 1 or 21 has a pouring box, upstream the partition 11 or 41, which is square or rectangular in shape when seen in top plan view, the closed box 63 is preferably cubic as shown in the drawings, and positioned to the pouring box in such a manner that its lateral walls 69 extend parallel or substantially parallel to the walls 29, 33 and 41. If, say, the end wall 29 of the tundish shown in FIG. 2 was rounded or semi-circular, it would be compulsory that the adjacent walls 69 of the stream breaker 61 be also rounded or semi-circular to "follow" the shape of the adjacent wall 29. Indeed, the key feature of the invention is that every sub-stream of molten metal escaping from an opening 71 flows toward the adjacent wall of the tundish in a direction substantially perpendicular to this adjacent wall, to merely "bounce" onto the wall instead or being deflected by the same to create turbulences and eddy currents. Such a reduction of the turbulences and eddy currents in the pouring box is essential to prevent the slag formed in the pouring box from being entrained downstream to the flotation box, especially when the level of the metal in the tundish is or becomes very low.

To avoid technically difficult and expensive attachment of the stream breaker to the lower end of the injection nozzle 9 or 59, the closed box 63 is preferably sized and shaped in such a manner as to lay flat on the bottom wall 7 or 27 of tundish, just under the injection nozzle 9 or 59 respectively.

Tests hereinafter reported that were carried out by the Applicants on a full-scale water model where the slag was represented by small pieces of polystyrene, have shown that the openings 71 must be square to achieve the best results.

The openings 71 must however be large enough not to unduly restrict the flow of metal fed into the pouring box. They must also be large enough not to be plugged by the molten metal or the small inclusions that it may contain. However, they may advantageously act as a trap to catch the large inclusions that may be present in the molten metal stream.

There is no general rule for the thickness of the lateral walls 69 forming the box 63. However, it may be understood that the thicker the walls are, the higher will be the energy dissipation because of the friction of the metal flowing through the thickness of the openings 71. The test referred to hereinabove that were carried out by the Applicants have also shown that the stream breaker 61 reduces to a substantial extent the turbulences generated when the molten metal is injected from the ladle inside the pouring box, even if the level of the molten metal in the pouring box and tundish is rather low.

The following tables show the results of the tests that were carried out by the Applicant with a full scale water model. Water modeling was conducted in the Ecole Polytechnique de Montreal's Laboratory.

The tundishes were made from 19 mm. thick lucite sheets to allow visualization of the flow stream under different operating conditions in relationship with vortexing and slag entrainment. A 7.62 cm diameter ABS pipe was used to simulate the ladle shroud aand a real tundish-to-mold submergence nozzle was set in the bottom of the tundish at the other thereof. Flow from the tundishes into the mold was controlled by a stopper rod suspended above the nozzle entry and linked to a manual lever.

Flow visualization was achieved by injecting a fixed amount of potassium permanganate tracer into the ladle stream. An optical probe was fixed at the entry of the submerged nozzle and readings of water transmittance were recorded by a chart recorder via a colorimeter.

The respective proportions of well-mixed flow, plug flow and dead flow volumes were derived from the peak concentration, mean time and minimum retention time by using a stimulus response technique.

The slag entrainment was visualized by using red polyethylene beads having a diameter varying from 2 to 3 mm and a density of 0.8. Colored photographs and video-tapes were taken for various configurations tested.

The tests were carried out both with a tundish of conventional structure as shown in FIG. 1 (see table 1) and with an improved tundish as shown in FIG. 2 (see table 2). In both cases, the tundish was provided with a cubic ladle stream breaker according to the invention, provided with thick lateral walls with openings of about 1.5 cm.

TABLE I

| Height of metal in tundish | Residence time (sec) | plug flow volume (%) | turbulent volume (%) | stagnant volume (%) |
|---|---|---|---|---|
| 31 | 61 | 36 | 55 | 9 |
| 36 | 63 | 32 | 54 | 14 |
| 41 | 64 | 28 | 53 | 19 |
| 51 | 61 | 20 | 53 | 27 |
| 61 | 62 | 16 | 49 | 35 |
| 71 | 65 | 14 | 48 | 38 |

TABLE II

| Height of metal in tundish (cm) | Residence time (sec) | plug flow volume (%) | turbulent volume (%) | stagnant volume (%) |
|---|---|---|---|---|
| 31 | 81 | 38 | 57 | 5 |
| 36 | 86 | 35 | 57 | 8 |
| 41 | 92 | 33 | 58 | 9 |
| 51 | 106 | 30 | 58 | 12 |
| 61 | 130 | 30 | 54 | 16 |
| 71 | 146 | 28 | 54 | 18 |

As can be seen, in both cases, the percentage of turbulent volume noted in the tundish remained steady whatever was the height of metal poured into the tundish. In addition, with the tundish 21 shown in FIG. 2, the percentage of plug flow volume downstream the partition of the flotation box also remained steady whatever was the height of metal in the tundish.

In addition, in both of these tests, it was noted that, even when the level of metal became very low, the upper surface of the metal was not perturbated in the pouring box. The ladle stream breaker according to the invention thus acted as an efficient "buffer".

The embodiments of the invention in which an exclusive property or privilege is claimed are defined as follows:

1. In a tundish comprising a pouring zone which is square in shape and has a flat bottom wall and wherein a stream of molten metal is poured from a ladle through a pouring tube, and a floatation zone downstream from the pouring zone, the improvement comprising a ladle stream breaker having a closed box lying flat on the bottom wall of the pouring zone directly under the pouring tube, said closed box being made of a refractory material and having a flat bottom wall, a top wall provided with an opening sized to receive the lower end of the pouring tube, and four lateral thick walls each provided with a plurality of square-shaped openings sized to allow the molten metal injected into the box through the nozzle to escape from said box in the form of a plurality of sub-streams of lower energy, said lateral walls and openings being arranged in such a manner that every sub-stream flowing out of its associated opening impinges a wall of the tundish and flows in a direction substantially perpendicular to said tundish wall.

2. A method for dissipating kinetic energy of a stream of molten metal poured from a casting ladle into a tundish comprising the steps of:

pouring a stream of molten metal from said casting ladle through a pouring tube of said tundish and a floatation zone downstream from the pouring tube;

injecting said stream of molten metal from said pouring tube into a ladle stream breaker which comprises a closed box having a plurality of square openings on lateral walls of said closed box, said lateral walls being made of a thick layer of refractory material;

trapping an amount of said stream of molten metal in said ladle stream breaker so as to cut off impact of the injected stream, thereby effecting a dissipation of kinetic energy; and allowing the molten metal injected into said ladle stream breaker to escape from said closed box through said square openings in the form of a plurality of substreams of lower energy so as to effect further dissipation of kinetic energy.

3. The method of claim 2, including increasing said kinetic energy dissipation by reducing the size of said openings.

4. The method of claim 2, including increasing said kinetic energy dissipation by increasing the thickness of said lateral walls.

* * * * *